US006189277B1

(12) United States Patent
Boscamp

(10) Patent No.: US 6,189,277 B1
(45) Date of Patent: Feb. 20, 2001

(54) FIRESTOP CAVITY OCCLUSION FOR METALLIC STUD FRAMING

(75) Inventor: Jeffrey A. Boscamp, Mesa, AZ (US)

(73) Assignee: Palo Verde Drywall, Inc., Phoenix, AZ (US)

( * ) Notice: Under 35 U.S.C. 154(b), the term of this patent shall be extended for 0 days.

(21) Appl. No.: 09/206,831

(22) Filed: Dec. 7, 1998

(51) Int. Cl.[7] ..... E04B 1/94

(52) U.S. Cl. ..... 52/317; 52/696; 52/731.5; 52/731.9; 52/481.1; 52/712; 248/300

(58) Field of Search ..... 52/317, 283, 653.1, 52/655.1, 665, 696, 731.5, 731.9, 739.1, 481.1, 712, 715; 248/300, 57

(56) References Cited

U.S. PATENT DOCUMENTS 1,412,736 * 4/1922 Hamilton ..... 52/317
1,867,449 * 7/1932 Ecket et al. ..... 52/317 X
2,099,961 * 11/1937 McLaughlin, Jr. ..... 52/317 X
2,994,114 * 8/1961 Black ..... 52/317
3,680,271 * 8/1972 Satchell ..... 52/696 X
3,778,952 * 12/1973 Soucy ..... 52/696 X
4,455,802 * 6/1984 Charniga ..... 52/317
4,464,074 * 8/1984 Green et al. ..... 52/665 X
4,608,801 * 9/1986 Green et al. ..... 52/664
4,791,766 * 12/1988 Egri, II ..... 52/317
5,189,857 * 3/1993 Herren et al. ..... 52/317

* cited by examiner

*Primary Examiner*—Laura A. Callo
(74) *Attorney, Agent, or Firm*—Jordan M. Meschkow; Lowell W. Gresham; Meschkow & Gresham, P.L.C.

(57) ABSTRACT

A frame wall (20) incorporating occlusion brackets (26) is provided. The frame wall (20) incorporates a pair of adjacent and substantially parallel framing members (22). Each framing member (22) has a substantially U-shaped cross section and encompasses an interior space (34). A firestop (44) is positioned between the adjacent framing members (22). A first occlusion bracket (26) is used to affixed the firestop (44) to a first one of the framing members (22) and is configured to substantially occlude the interior space (34) of that framing member (22). A second occlusion bracket (26) is used to affix the firestop (44) to a second one of the framing members (22).

23 Claims, 4 Drawing Sheets

FIRESTOP CAVITY OCCLUSION FOR METALLIC STUD FRAMING

TECHNICAL FIELD OF THE INVENTION

The present invention relates to the field of frame walls. More specifically, the present invention relates to firestops within metal frame walls.

BACKGROUND OF THE INVENTION

Fire safety is a concern in the construction of frame wall buildings. When such a building is intended for human occupancy, fire safety increases in importance, as the occupants may often be asleep, hence especially vulnerable, in the event of a fire. Construction techniques that inhibit the rapid spread of fire are therefore common in the construction industry.

One such frame-wall construction technique is the affixment of firestops between adjacent studs. It is the function of a firestop to "stop" (i.e., block or close up) the cavity between the studs. By so doing, the ability of the cavity to act as a chimney for smoke, combustion gasses, etc., is inhibited, and the ability of the fire to spread up the wall to an upper story or roof is inhibited.

One modern frame-wall construction technique utilizes metal channeling, typically formed of sheet steel, as studs and other framing members. Structures utilizing such metal-frame construction provide an alternative to traditional wood-frame structures, offering reduced construction time, improved strength, decreased weight, and a significant reduction in overall flammability.

Inasmuch as such metal framing members are channels having a substantially U-shaped cross section, hence an open interior space, a problem arises in the fitting of firestops. Unless interior space would provide an opening around a firestop sufficient to produce a chimney effect in the event of a fire. This poses a significant safety hazard.

Conventional metal-frame construction requires that a firestop be conformingly trimmed so as to occlude the interior space of the stud(s) to which it is affixed. This is a labor-intensive process, involving the use of snips or other hand-operated cutters. Such a process is time-consuming, hence costly. What is needed, therefore, is a way to affix a firestop between studs in a metal-frame structure that occludes the stud interior space wherein the only cutting of the firestop is to length, i.e., without requiring the firestop to be trimmed or cut to shape. This methodology often inadequately occludes the interior space of at least one of the adjacent framing members, requiring the insertion of rock wool, fiberglass, or other occludent material.

Additionally, conformingly trimming a firestop by hand poses a potential danger to the worker. The cut edges of sheet-steel channels tend to be sharp. In the course of trimming and otherwise manipulating the firestop, a significant risk of laceration or other injury is present. What is needed, therefore, is a reduction of conformingly trimming and/or handling of the firestop so as to reduce the potential for injury.

Also, because such metal framing members have U-shaped cross sections, the use of metal studs in closely studded areas, such as wall corners and junctions, creates a vertical cavity. This is in marked contrast to the use traditional wood studs which, being solid, do not produce such a cavity. Such vertical cavities act as chimneys in the event of fire. Provisions should be made in metal-frame structures to occlude such chimneys. Again, these provisions conventionally require the insertion of a short, conformingly trimmed firestop. What is needed in this case is a way of occluding the resultant vertical cavities without interfering with the spacing and distribution of such close-proximity studs.

SUMMARY OF THE INVENTION

It is an advantage of the present invention that a firestop cavity occlusion for metallic stud framing is provided.

It is another advantage of the present invention that a bracket is provided to affix a firestop to a metal framing member while occluding an interior space of that framing member.

It is another advantage of the present invention that a bracket is provided to affix a firestop to a framing member without requiring the firestop to be conformingly trimmed.

It is another advantage of the present invention that a bracket is provided to occlude a vertical cavity between closely spaced framing members.

These and other advantages are realized in one form by an occlusion bracket for use in a frame wall incorporating a U-shaped framing member having a predeterminately dimensioned interior space, wherein the occlusion bracket comprises an occludent component factory-configured to substantially occlude the framing-member interior space, a mounting flange coupled to the occludent component and configured to affix the occlusion bracket to the framing member, and an extension flange coupled to the occludent component.

These and other advantages are realized in another form by a frame wall comprising a first U-shaped framing member having an interior space, a first occlusion bracket affixed to the first framing member and configured to substantially occlude the framing-member interior space, a second substantially identical framing member adjacent and substantially parallel to the first framing member, a firestop positioned between the first and second framing members and affixed to the first occlusion bracket, and a second occlusion bracket affixed to the second framing member and the firestop.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
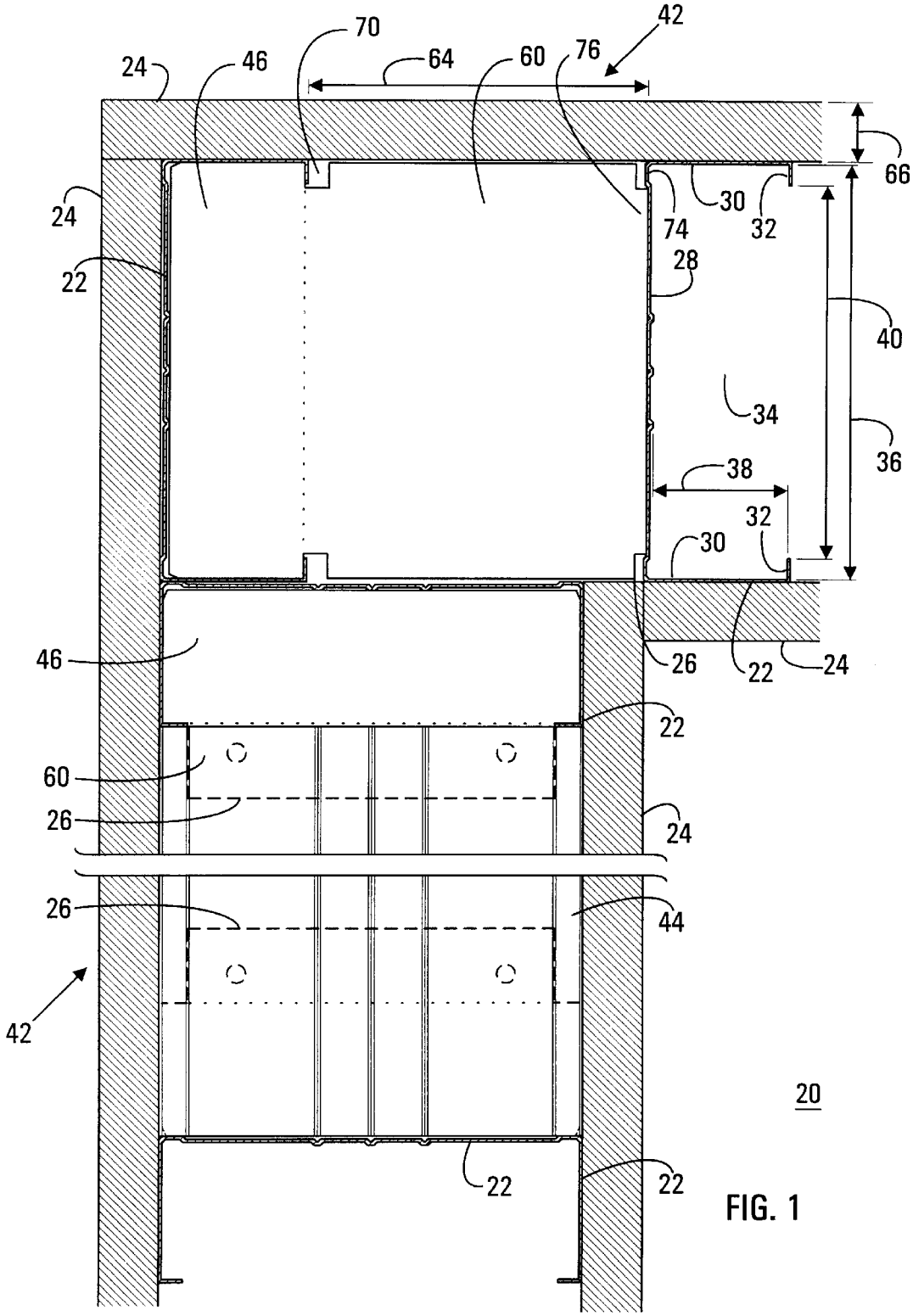
FIG. 1 depicts a plan view of a section of a frame wall utilizing sheet metal framing members, cladding, and occlusion brackets in accordance with a preferred embodiment of the present invention.
Figure 2:
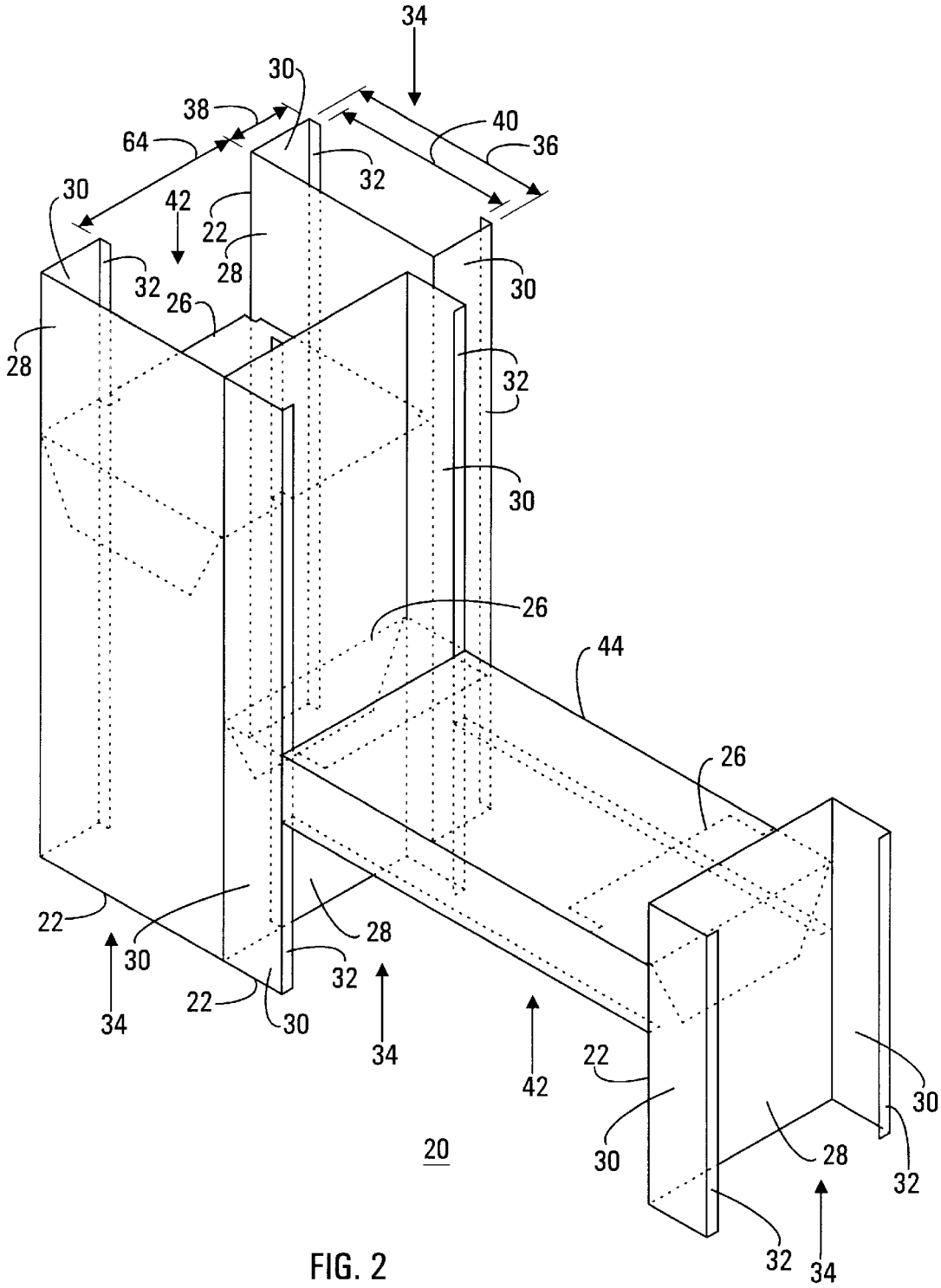
FIG. 2 depicts an isometric view of the section of frame wall depicted in FIG. 1 with cladding removed in accordance with a preferred embodiment of the present invention.

FIG. 1 depicts a plan view of a section of a frame wall 20 utilizing sheet metal framing members 22, cladding 24, and occlusion brackets 26 in accordance with a preferred embodiment of the present invention. FIG. 2 depicts an isometric view the section of frame wall 20 depicted in FIG. 1 with cladding 24 removed. The following discussion refers to FIGS. 1 and 2.

Cladding 24 serves as the exposed outer surfaces of frame wall 20, and is typically of plasterboard, cementboard, plywood, or other material well known to those skilled in the art. Cladding 24 is affixed to framing members 22, typically by screws or other means well-known to those skilled in the art.

A plurality of framing members 22 is used in the construction of frame wall 20. Framing members 22, as discussed herein, make up the principal vertical structural members of frame wall 20, i.e., the studs. Short portions of four of framing members 22 are depicted in FIGS. 1 and 2.

The strength of framing members 22 lies in their material and shape. In the preferred embodiment, a strip of sheet metal is bent into each framing member 22. Each framing member 22 has a face 28, a pair of opposing sides 30 formed by bending the sheet metal strip substantially perpendicularly along each edge of face 28, and a pair of lips 32 formed by bending the sheet metal strip inward substantially perpendicularly along edges of sides 30 so as to oppose face 28. In this manner, framing members 22 attain substantially U-shaped cross-sections, providing both stability and strength.

The U-shaped cross section of each framing member 22 may be envisioned as substantially an open rectangle encompassing an interior space 34. Being substantially rectangular, interior space 34 has a breadth 36 determined by the distance between opposing sides 30, and a depth 38 determined by the distance between face 28 and either of lips 32. Since one "side" of the open rectangle is formed by lips 32 and the opening between them, interior space 34 also has an opening breadth 40 determined by the distance between lips 32.

The methodology used to fabricate framing members 22, as well as any appurtenances thereof, e.g., groves, perforations, mounts, embossments, and the like, are well known to those skilled in the art and are beyond the scope of the present invention.

The methods and means used to assemble framing members 22 into frame wall 20, and the methods and means used to affix cladding 24 to framing members 22, are also well known to those skilled in the art and beyond the scope of the present invention. The use of fasteners, such as self-tapping sheet-metal screws, is assumed to be the desired method and means of affixment throughout this discussion. For purposes of simplicity and clarity, such fasteners are not depicted in the Figures.

When cladding 24 has been affixed to framing members 22, frame wall 20 becomes a series of vertical cavities, i.e., inter-member spaces 42. In the event of fire, it is possible inter-member spaces 42 may function as chimneys (the "chimney effect") and convey smoke, gasses, and other combustion byproducts upward. It is therefore desirous, and often required by code, that inter-member spaces 42 be occluded to inhibit this chimney effect.

A firestop 44 is used to occlude inter-member space 42. In general, firestop 44 is a horizontal framing member mounted between adjacent vertical framing members 22. Firestop 42 can be substantially identical to a vertical framing member 22 (i.e., a stud) save for length and orientation, and is often a cut-down portion of an uninstalled framing member 22.

Figure 3:
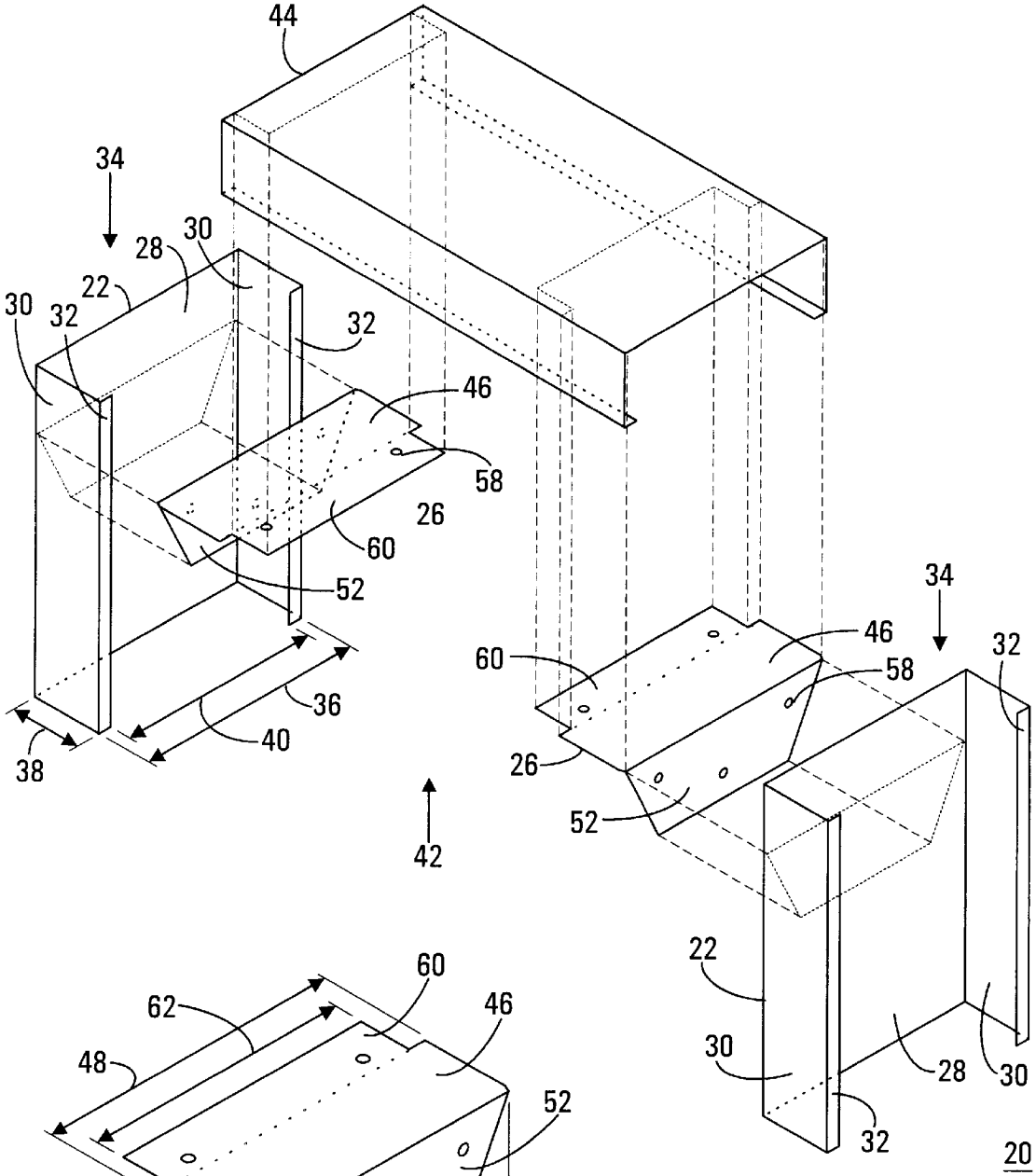
FIG. 3 depicts an exploded isometric view of a portion of the frame wall depicted in FIG. 2 encompassing a firestop in accordance with a preferred embodiment of the present invention.
Figure 4:
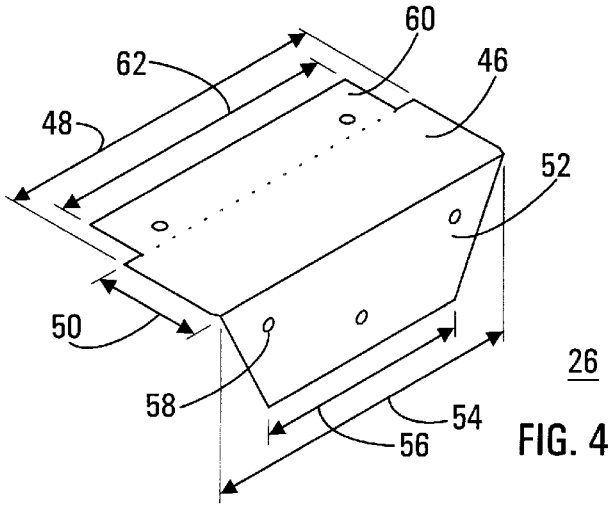
FIG. 4 depicts an isometric view of an occlusion bracket configured for use with a firestop in accordance with a preferred embodiment of the present invention.

FIG. 3 depicts an exploded isometric view of a portion of the section of frame wall 20 depicted in FIG. 2 encompassing a firestop 44, while FIG. 4 depicts an isometric view of occlusion bracket 26 configured for use with firestop 44 in accordance with a preferred embodiment of the present invention. The following discussion refers to FIGS. 1 through 4.

Framing members 22 are typically like-oriented within a given section of frame wall 20. That is, all framing members 22 in a given wall 20, except the last framing member 22 (not shown), are typically oriented in the same direction. Lips 32 of one framing member 26 thus oppose face 28 of an adjacent framing member 22. Therefore, when firestop 44 is affixed between framing members 22, firestop 44 extends between lips 32 of the one framing member 22 and face 28 of the adjacent framing member 22. Firestop 44 therefore does not occlude interior space 34 of the one framing member 22 in which lips 32 face firestop 44.

In the preferred embodiment, frame wall 20 incorporates occlusion bracket(s) 26 to affix firestop 44 to framing member 22. Occlusion brackets 26 are factory-configured components of frame wall 20. That is, occlusion brackets 26 are typically formed of sheet metal, e.g., sheet steel, cut and bent to the appropriate shape in a factory where they are produced in quantity to be used as required in the construction of frame wall 20. This is possible because, as is well known to those skilled in the art, industry standards have been established predetermining the dimensions of interior spaces 34 of framing members 22. The use of occlusion brackets 26 to affix firestops 44 to framing members 22 obviates the need to conformingly trim firestops 44 and significantly expedites the construction of frame wall 20 as well as decreasing the risk of associated injury.

Since occlusion brackets 26 are used to affix firestops 44 to framing members 22, occlusion brackets 26 desirably have no less inherent strength than either firestops 44 or framing members 22. Assuming framing members 22 are formed of sheet steel of a predetermined thickness and firestops 44 are substantially identical to framing member 22 save for length and orientation, occlusion brackets 26 should be formed of sheet steel of an equal or greater thickness than that predetermined thickness.

Occlusion bracket 26 is inserted into interior space 34 and affixed to face 28 of framing member 22, thus occluding interior space 34. Firestop 44 is then abutted against framing member 22 and affixed to occlusion bracket 26. Through the use of occlusion bracket 26 and firestop 44, inter-member space 42 is sufficiently occluded to inhibit a potential chimney effect.

Occlusion bracket 26 incorporates an occludent component 46 dimensioned to occlude framing-member interior space 34. That is, occludent component 46 has a breadth 48 and a depth 50 substantially equal to interior-space breadth 36 and interior-space depth 38, respectively.

Occludent component 46 is typically configured to occlude interior space 34 when perpendicular to both framing-member face 28 and framing-member sides 30, i.e., when positioned horizontally within and across the breadth and depth of a vertical framing member 22. In this orientation, occludent-component breadth 48 and occludent-component depth 50 represent the actual breadth and depth of occludent component 46. Those skilled in the art will appreciate, however, that this perpendicularity is not a requirement of the present invention, and that occludent component 46 may be configured to occlude interior space 34 when at a non-perpendicular angle to framing-member face 28 and/or framing-member sides 30. It should be understood that when positioned non-perpendicularly, the measurements of occludent-component breadth 48 and occludent-component depth 50 retain perpendicularity and do not represent the actual breadth and depth of occludent component 46.

Occlusion bracket 26 also incorporates a mounting flange 52 coupled to occludent component 46 and configured to affix occlusion bracket 26 to framing-member face 28. In the preferred embodiment, mounting flange 52 is tapered for easy insertion between framing-member lips 32 and into interior space 34. Since mounting flange 52 is tapered, it has a greater breadth 54 where it couples to occludent component 46 and a lesser breadth 56 opposing greater breadth 54. Greater mounting-flange breadth 54 is substantially equal to or less than occludent-component breadth 48, i.e., substantially equal to or less than interior-space breadth 36.

In the preferred embodiment, greater mounting-flange breadth 54 is less than interior-space breadth 36. Similarly, lesser mounting-flange breadth 56 is less than greater mounting-flange breadth 54 and desirably less than interior-space opening breadth 40. This is desirous so as to allow easy manual insertion and orientation of occlusion bracket 26 within framing member 22. Those skilled in the art will appreciate that mounting flange 52 need not smoothly taper to fulfill this function. That is, mounting flange 52 may have a step structure between greater and lesser breadths 54 and 56, may be rectangular with greater and lesser breadths 54 and 56 substantially equal, or any variation thereof. The embodiment of these and/or other variations does not constitute a departure from the spirit of the present invention or the scope of the appended claims.

It is desirable that a natural springiness of the metal material of which framing-member 22 is fabricated holds occlusion bracket 26 in place once inserted into and positioned within framing member 22. This is accomplished by having occludent-component breadth and depth 48 and 50 substantially equal to interior-space breadth and depth 36 and 38, respectively. Embossments and other appurtenances of framing member 22 aid in this function. This position-holding feature significantly reduces construction time for frame wall 20 over that of walls using conventional brackets.

Once inserted into and positioned within framing member 22, occlusion bracket 26 is desirably affixed to framing member 22 by fasteners (not shown), such as self-tapping sheet-metal screws. To aid in this endeavor, it is desirable that mounting flange 52 be equipped with at least one hole 58 through which a fastener may pass. The use of hole(s) 58, together with the afore-mentioned position-holding feature, allows for rapid, one-handed fastener insertion. Since firestop 44 will be coupled to occlusion bracket 22 (discussed hereinbelow), it is desirable that occlusion bracket 26 be firmly affixed to framing member 22 in a substantially perpendicular attitude relative to a surface of frame wall 20. It is desirable, therefore, that at least two holes 58 be present in mounting flange 52, so that at least two fasteners may be used to inhibit rotation of occlusion bracket 26 within framing member 22 after affixment.

In the preferred embodiment, occlusion bracket 26 also incorporates an extension flange 60 coupled to occludent component 46 and configured to affix firestop 44 to occlusion bracket 26. Since occlusion bracket 26 is affixed to framing member 22, affixing firestop 44 to extension flange 60, i.e., to occlusion bracket 26, affixes firestop 44 to framing member 22.

Since firestop 44 is desirably substantially perpendicular to framing member 22, extension flange 60 is substantially perpendicular to mounting flange 52. In the preferred embodiment where mounting flange 52 is perpendicular to occludent component 46, extension flange 60 is coplanar with and essentially an extension of occludent component 46.

Extension flange 60 protrudes out of framing-member interior space 34. Therefore, at least a portion of extension flange 60 desirably has a breadth 62 less than interior-space breadth 36 and less than interior space opening breadth 40.

It is desirable that extension flange 60 be equipped with at least one hole 58 through which a fastener (not shown) may pass. Again, the use of hole(s) 58 allows for rapid, one-handed fastener insertion. By firmly affixing firestop 44 to occlusion bracket 22, firestop 44 is firmly affixed within frame wall 20 in the desired position.

Firestop 44 has two ends, one of which is positioned proximate lips 32 of one framing member 22 and the other of which is positioned proximate face 28 of an adjacent framing member 22. In the preferred embodiment, an occlusion bracket 26 may also be used as an angle bracket to affix an end of firestop 44 to face 28 of the adjacent framing member 22. The use of occlusion bracket 26 as an angle bracket offers a significant savings in time over cutting and forming firestop 44 to effect a flange. Additionally, the use of occlusion bracket 26 as an angle bracket obviates the need to stock other angle brackets, thus eliminating the need to inventory such brackets.

Figure 5:
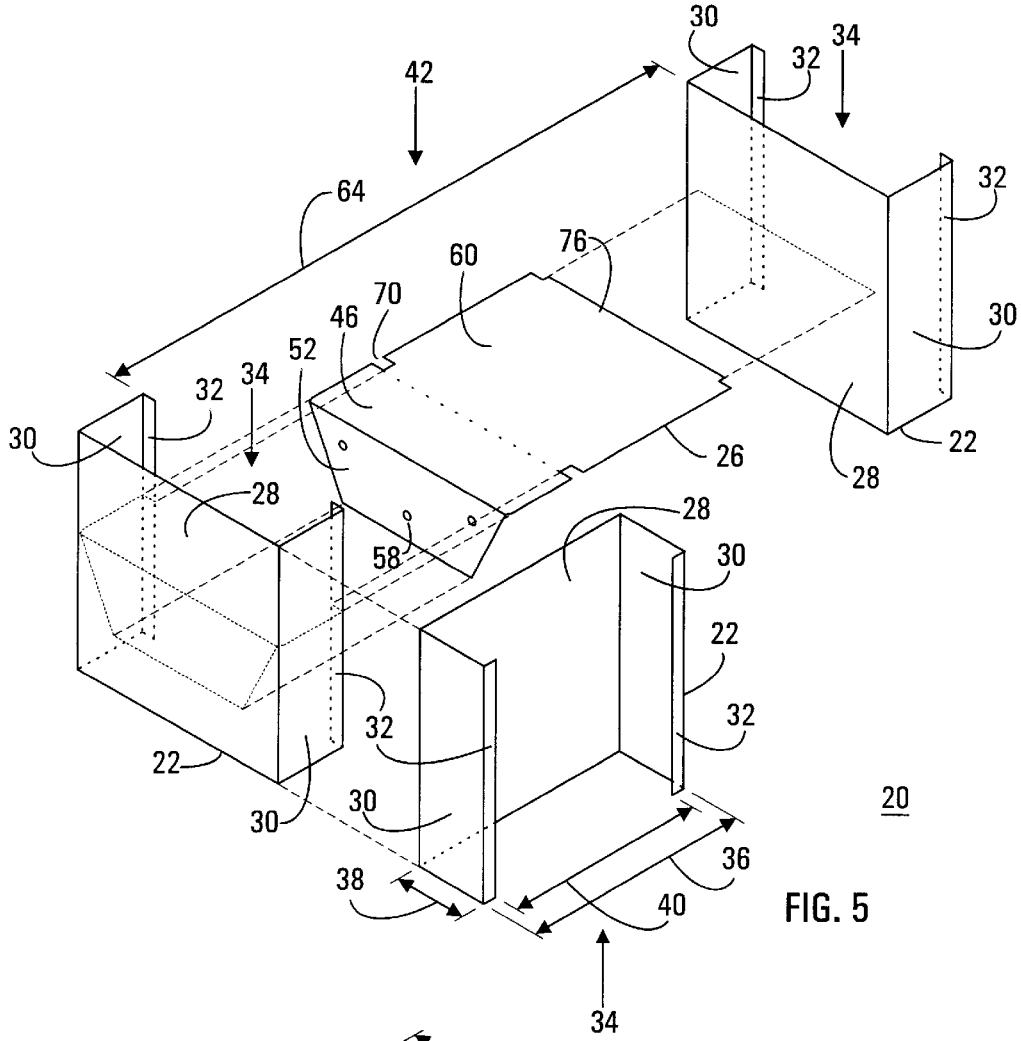
FIG. 5 depicts an exploded isometric representation of a portion of the frame wall depicted in FIG. 2 encompassing a corner in accordance with a preferred embodiment of the present invention.
Figure 6:
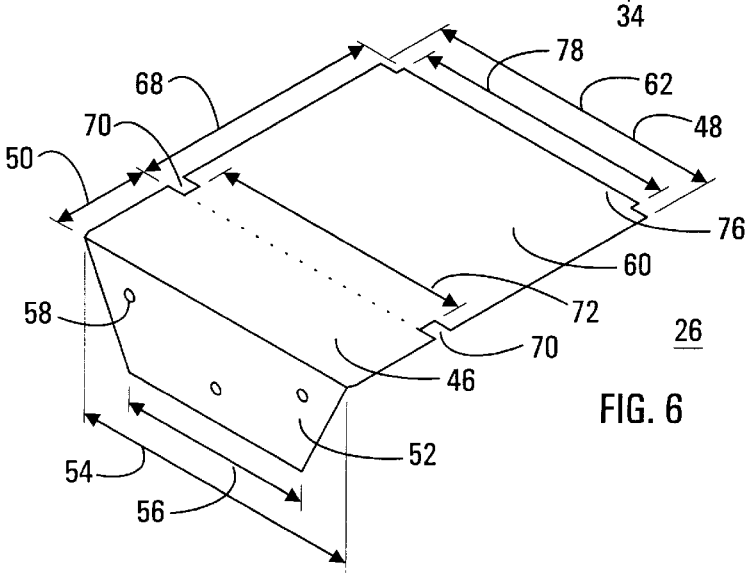
FIG. 6 depicts an isometric view of an occlusion bracket configured for use with proximate framing members in accordance with a preferred embodiment of the present invention.

FIG. 5 depicts an exploded isometric view of a portion of the section of frame wall 20 depicted in FIG. 2 encompassing a corner in accordance with a preferred embodiment of the present invention, while FIG. 6 depicts an isometric view of an occlusion bracket 26 configured for use with proximate framing members 22 in accordance with a preferred embodiment of the present invention. The following discussion refers to FIGS. 1, 2, 5, and 6.

In the construction of corners or other junctions in frame wall 20, it is often desirable to have framing members 22 positioned proximate and substantially parallel to each other so as to provide mounting surfaces for cladding 24. In FIGS. 1, 2, and 5, a typical frame-wall corner is depicted which utilizes two such proximate flaming members 22.

As described hereinbefore, inter-member space 42 encompassed by adjacent framing members 22 and cladding 24 may act as a chimney in the event of fire. It is therefore desirable that a damper be placed within any such potential chimney.

The distance between such adjacent framing members 22 determines a depth 64 for inter-member space 42. Framing members 22 are proximate, making inter-member depth 64 relatively small. Desirably, inter-member depth 64 is that minimum dimension that allows cladding 24 to be securely affixed to framing members 22 at perpendicular junctions (corners) of frame wall 20. Ignoring the thickness of the sheet metal from which framing members 22 are fabricated, the desirable inter-member depth 64 is typically substantially equal to interior-space breadth 36 plus a thickness 66 of cladding 24 less interior-space depth 38. Such a small inter-space depth 64 does not lend itself well to the use of firestop 44 as the desired damper.

Extension flange 60 may be dimensioned to occlude inter-member space 42, thus eliminating any potential chimney-effect therein. In this embodiment, extension flange 60 desirably has a breadth 62 substantially equal to interior-space breadth 36, i.e., substantially equal to occludent component breadth 48, and a depth 68 substantially equal to inter-member depth 64.

Additionally, in this embodiment, extension flange 60 couples to occludent component 46 with a pair of opposing notches 70 to allow for framing-member lips 32. An inter-notch breadth 72, i.e., the distance between notches 70, is less than interior-space opening breadth 40 so that lips 32 may fully reside within notches 70.

In many embodiments of framing member 22, there are formed small ridges 74 (FIG. 1) on face 28 where face 28 joins sides 30. Ridges 74 are typically the counterpart of lips 32 and have similar dimensions. That is, ridges 74 are typically separated by a distance substantially equal to interior-space opening breadth 40. The formation of ridges 74 is not a part of and beyond the scope of the present invention.

To maximally occlude inter-member space 42, it is desirable that extension flange 60 have a lip 76 with a breadth 78 substantially equal to or less than interior-space opening breadth 40.

In summary, the present invention teaches a firestop cavity occlusion for metallic-stud frame walls 20. In one preferred embodiment, the firestop cavity occlusion is realized as an occlusion bracket 26 affixing a firestop 44 to a framing member 22 while occluding an interior space 34 of that framing member 22 without requiring firestop 44 to be conformingly trimmed. In another preferred embodiment, occlusion bracket 26 is factory-configured to occlude a vertical cavity, i.e., inter-member space 42, between proximate framing members 22.

Although the preferred embodiments of the present invention have been illustrated and described in detail, it will be readily apparent to those skilled in the art that various modifications may be made therein without departing from the spirit of the invention or from the scope of the appended claims.

What is claimed is:

1. An occlusion bracket for use in a frame wall incorporating U-shaped framing members, each of which has a predeterminately dimensioned interior space, said occlusion bracket comprising:

only one occludent component factory-configured to substantially occlude said interior space of a first one of said framing members so as to substantially inhibit a chimney effect therein;

a mounting flange coupled to said occludent component and configured to affix said occlusion bracket to said first framing member; and an extension flange coupled to said occludent component.

2. An occlusion bracket as claimed in claim 1 wherein:

said first framing member is a stud;

a second one of said framing members is a firestop substantially perpendicularly coupled to said stud; and said extension flange is configured to affix said occlusion bracket to said firestop.

3. An occlusion bracket as claimed in claim 2 wherein:

said mounting flange is substantially perpendicular to said occludent component; and said extension flange is substantially perpendicular to said mounting flange.

4. An occlusion bracket as claimed in claim 1 wherein:

said first framing member is proximate and substantially parallel to a second one of said framing members;

a space within said frame wall between said first and second framing members is an inter-member space; and said extension flange is configured to substantially occlude said inter-member space so as to substantially inhibit a chimney effect therein.

5. An occlusion bracket as claimed in claim 1 wherein said mounting flange exhibits a first mounting-flange breadth where said mounting flange couples to said occludent component, and a second mounting-flange breadth in opposition to said first mounting-flange breadth, wherein said second mounting-flange breadth is less than said first mounting-flange breadth.

6. An occlusion bracket as claimed in claim 5 wherein said mounting flange tapers from said first mounting-flange breadth to said second mounting-flange breadth.

7. A frame wall comprising:

a plurality of substantially identical U-shaped framing members, wherein each of said framing members has a predeterminately dimensioned interior space encompassed by a face, opposing first and second sides substantially perpendicular to said face, and first and second lips substantially perpendicular to said first and second sides and in opposition to said face;

a cladding affixed to said framing members; and an occlusion bracket affixed to a first one of said framing members, wherein said occlusion bracket is factory-configured to substantially occlude said interior space of said first framing member so as to substantially inhibit a chimney effect therein.

8. A frame wall as claimed in claim 7 wherein said occlusion bracket comprises:

an occludent component factory-configured to substantially occlude said interior space of said first framing member;

a mounting flange coupled to said occludent component and configured to affix said occlusion bracket to said first framing member; and an extension flange coupled to said occludent component.

9. A frame wall as claimed in claim 8 wherein said extension flange is substantially perpendicular to said mounting flange.

10. A frame wall as claimed in claim 9 wherein said mounting flange is substantially perpendicular to said occludent component.

11. A frame wall as claimed in claim 8 wherein:

said first framing member is a first stud;

a second one of said framing members is a second stud adjacent to said first stud;

a third one of said framing members is a firestop positioned between said first and second studs, affixed to said occlusion bracket, and configured to substantially inhibit a chimney effect between said first and second studs.

12. A frame wall as claimed in claim 11 wherein:

said occlusion bracket is a first occlusion bracket; and said frame wall additionally comprises a second occlusion bracket affixed to said second stud and said firestop.

13. A frame wall as claimed in claim 8 wherein:

said first framing member is proximate and substantially parallel to a second one of said framing members;

a space within said frame wall between said first and second framing members is an inter-member space; and said extension flange is configured to substantially occlude said inter-member space to substantially inhibit a chimney effect therein.

14. A frame wall as claimed in claim 8 wherein said mounting flange has a first hole configured to pass a first fastener for affixing said occlusion bracket to said first framing member.

15. A frame wall as claimed in claim 14 wherein said extension flange has a second hole configured to pass a second fastener for affixing said occlusion bracket to a second one of said framing members.

16. A frame wall as claimed in claim 7 wherein:

each of said framing members exhibits a predetermined interior-space breadth as a distance between said opposing sides and a predetermined interior-space depth as a distance between said face and one of said lips;

said occludent component is factory-configured to exhibit a breadth substantially equal to said interior-space breadth and a depth substantially equal to said interior-space depth; and said mounting flange is factory configured to exhibit a breadth substantially equal to or less than said interior-space breadth.

17. A frame wall as claimed in claim 16 wherein:

said mounting-flange breadth is a greater mounting-flange breadth;

said mounting flange is factory-configured to exhibit a lesser mounting-flange breadth wherein said lesser mounting-flange breadth is less than said greater mounting-flange breadth; and said mounting flange tapers from said lesser mounting-flange breadth to said greater mounting-flange breadth.

18. A frame wall as claimed in claim 16 wherein:

each of said framing members exhibits a predetermined interior-space opening breadth as a distance between said lips; and said extension flange is factory configured to exhibit a breadth substantially equal to or less than said interior-space opening breadth.

19. A frame wall as claimed in claim 18 wherein:

said cladding exhibits a predetermined thickness; and said extension flange exhibits a breadth substantially equal to said interior-space breadth; and said extension flange exhibits a depth substantially equal to said interior-space breadth plus said cladding thickness less said interior-space depth.

20. A frame wall as claimed in claim 19 wherein:

said extension flange has opposing first and second notches configured to contain said first and second framing-member lips, respectively;

said extension flange is factory-configured to exhibit an inter-notch breadth as a distance between said first and second notches; and said inter-notch breadth is less than said interior-space opening breadth.

21. A frame wall as claimed in claim 19 wherein:

said extension flange has a lip configured to engage said face of a proximate other framing member; and said lip exhibits a breadth less than said interior-space breadth.

22. A frame wall as claimed in claim 7 wherein:

said framing members are fabricated of a sheet metal of a predetermined thickness; and said occlusion bracket is fabricated of a sheet metal of a thickness substantially equal to or greater than said predetermined thickness.

23. A frame wall comprising:

a first framing member having a predetermined substantially U-shaped cross section encompassing an interior space;

a first occlusion bracket affixed to said first framing member and configured to substantially occlude said framing-member interior space;

a second framing member having substantially said predetermined cross section and positioned adjacent and substantially parallel to said first framing member;

a third framing member having substantially said predetermined cross section, positioned between said first and second framing members, and affixed to said first occlusion bracket; and a second occlusion bracket affixed to said second and third framing members.

* * * * *